US010604926B2

(12) United States Patent
Beutler

(10) Patent No.: US 10,604,926 B2
(45) Date of Patent: Mar. 31, 2020

(54) DRAIN APPARATUS FOR MARINE VESSEL

(71) Applicant: Georg Fischer Harvel LLC, Little Rock, AR (US)

(72) Inventor: Michael Paul Beutler, Cabot, AR (US)

(73) Assignee: Georg Fischer Harvel LLC, Little Rock, AR (US)

( * ) Notice: Subject to any disclaimer, the term of this patent is extended or adjusted under 35 U.S.C. 154(b) by 50 days.

(21) Appl. No.: 15/971,313

(22) Filed: May 4, 2018

(65) Prior Publication Data

US 2019/0338504 A1 Nov. 7, 2019

(51) Int. Cl.
*B63B 13/00* (2006.01)
*E03F 5/06* (2006.01)

(52) U.S. Cl.
CPC ..... *E03F 5/06* (2013.01); *B63B 13/00* (2013.01); *B63B 2231/40* (2013.01)

(58) Field of Classification Search
CPC ..... B63B 13/00; B63B 19/26; B63B 2231/40; E03F 5/06
USPC ..... 114/182
See application file for complete search history.

(56) References Cited

U.S. PATENT DOCUMENTS 4,533,331 A * 8/1985 Bland ..... F02B 61/045 114/197
6,406,071 B1 * 6/2002 LaViola ..... E05B 1/0007 16/441
2007/0034577 A1 * 2/2007 Bayard ..... E03F 5/06 210/767
2016/0002906 A1 * 1/2016 Adams ..... E03F 5/0409 137/15.01

* cited by examiner

*Primary Examiner* — Stephen P Avila
(74) *Attorney, Agent, or Firm* — Harness, Dickey & Pierce, P.L.C.

(57) ABSTRACT

A drain pot includes a body and at least one flexible catch. The body has an inlet and an outlet. The inlet and the outlet are at opposing ends of the body and in fluid communication with each other. The at least one flexible catch extends from and is disposed around the body.

25 Claims, 5 Drawing Sheets

DRAIN APPARATUS FOR MARINE VESSEL

FIELD

The present disclosure relates to a drain apparatus for a marine vessel.

BACKGROUND

This section provides background information related to the present disclosure which is not necessarily prior art.

Drains for marine vessels are generally manufactured using a metal material (e.g., stainless steel or steel) and welded within an opening in the deck of the vessel. The metals drains are susceptible to corrosion and often require special connections to adapt to non-metallic marine vessel piping systems. Furthermore, the installation of these metal drains often present conditions that are unfavorable to the installer. The present disclosure provides a drain that is not subject to corrosion and is also conveniently installed into the deck of the marine vessel.

SUMMARY

This section provides a general summary of the disclosure, and is not a comprehensive disclosure of its full scope or all of its features.

In one form, the present disclosure provides a drain pot including a body and at least one flexible catch. The body having an inlet and an outlet at opposing ends thereof and in fluid communication with each other. The at least one flexible catch extends from and is disposed around the body.

In some configurations, the body is annular-shaped.

In some configurations, the body includes a top portion, an intermediate portion and a bottom portion.

In some configurations, the inlet is disposed at the top portion and the outlet is disposed at the bottom portion.

In some configurations, the inlet has a diameter that is wider than a diameter of the outlet.

In some configurations, the at least one flexible catch extends downwardly from the top portion of the body.

In some configurations, the top portion includes a first ledge and a second ledge.

In some configurations, a drain plate that is disposed on the first ledge of the top portion.

In some configurations, the body and the at least one flexible catch is made of a polymeric material.

In some configurations, the body includes another flexible catch extending from and disposed around the body.

In another form, the present disclosure provides a drain apparatus for a deck in a marine vessel. The drain apparatus including an adapter and a drain pot. The adapter is disposed within an opening in the deck of the marine vessel and is attached to the deck of the marine vessel. The drain pot is configured to be removably installed within the adapter and include a body and at least one flexible catch. The body has an inlet and an outlet at opposing ends thereof and in fluid communication with each other. The at least one flexible catch extends from and is disposed around the body and engages the adapter.

In some configurations, a fire stop is configured to be removably installed in a gap formed between the adapter and the body of the drain pot.

In some configurations, the drain pot is made of a polymeric material.

In yet another form, the present disclosure provides a drain apparatus for a deck in a marine vessel. The drain apparatus including an annular deck adapter and a polymeric drain pot. The deck adapter includes an annular body, and a ledge. The body has a top end, a bottom end and a side wall extending from the top end to the bottom end. The body extends downwardly in an opening in the deck. The ledge extends radially inwardly from the side wall of the body. The drain pot is configured to be removably installed within the body of the adapter.

In some configurations, the drain pot includes at least one flexible catch for engaging the ledge of the adapter.

In some configurations, the body includes a flange extending radially outwardly from the top end of the body such that the flange is flushed with the deck.

In some configurations, the top end of the body protrudes upwardly from the deck of the marine vessel and is flushed with a floor disposed on top of the deck.

In some configurations, the drain pot includes a plurality of flexible catches disposed around a body of the drain pot.

In some configurations, the drain pot includes a body having a top portion, an intermediate portion and a bottom portion.

In some configurations, the top portion extends radially outwardly from the intermediate portion and is seated on a top side of the ledge of the adapter, leaving a space between the body of the adapter and the intermediate portion of the drain pot.

In some configurations, a fire stop is configured to be removably installed in the space between the body of the deck adapter and the intermediate portion of the drain pot.

In some configurations, a drain cover plate is disposed on an inwardly projecting ledge formed in the top portion of the drain pot, above the ledge of the adapter and adjacent an end of the body of the drain pot.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
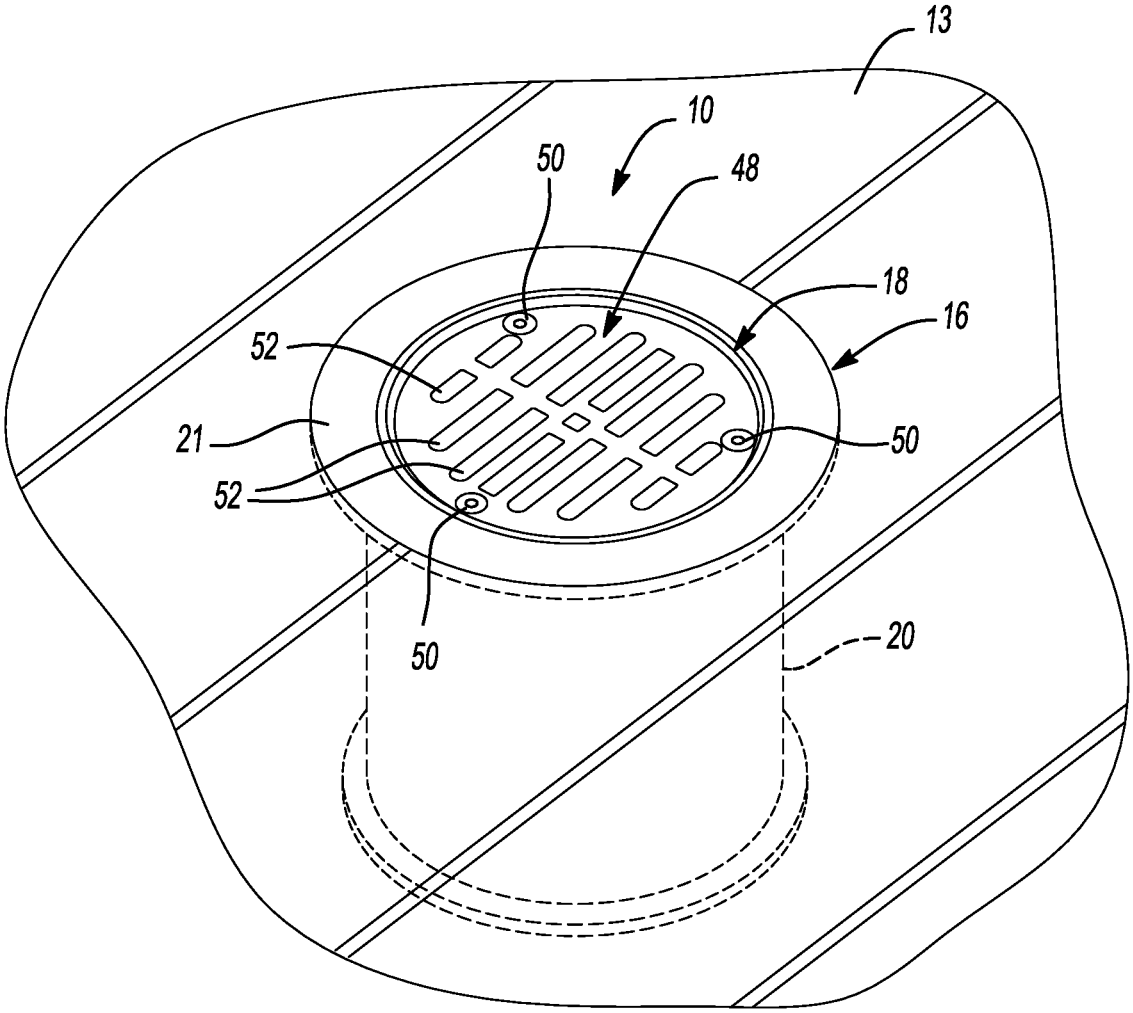
FIG. 1 is a perspective view of a drain apparatus disposed in an opening of a floor according to the principles of the present disclosure.
Figure 2:
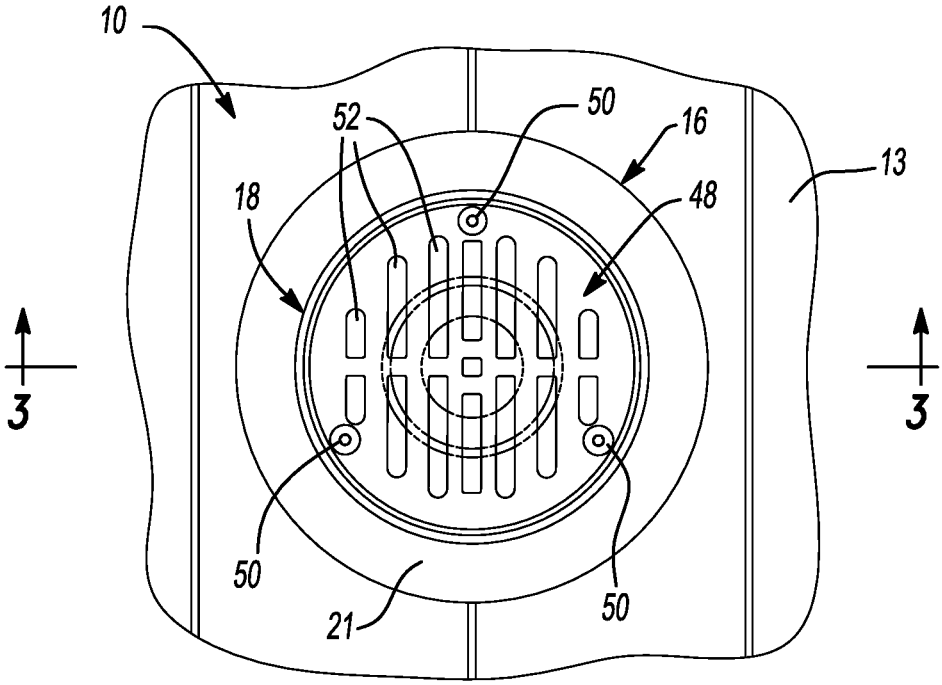
FIG. 2 is a top view of the drain apparatus of FIG. 1 disposed in the opening of the floor

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a drain apparatus 10 is provided. The drain apparatus 10 is disposed within an opening 12 in a floor 13 (e.g., a deck in a marine vessel) such that fluids and debris may drain therefrom and into a drain system 14 attached to the drain apparatus 10 (via a fitting 15). The drain apparatus 10 includes a deck adapter 16, a drain pot 18 and a fire stop 19. The deck adapter 16 is annular-shaped and made of a metallic material. The deck adapter 16 is disposed within the opening 12 in the floor 13 and fixedly attached to the floor 13 using any suitable method of attachment (e.g., welding). The deck adapter 16 includes an annular body 20, a flange 21 and a ledge 22.

Figure 3:
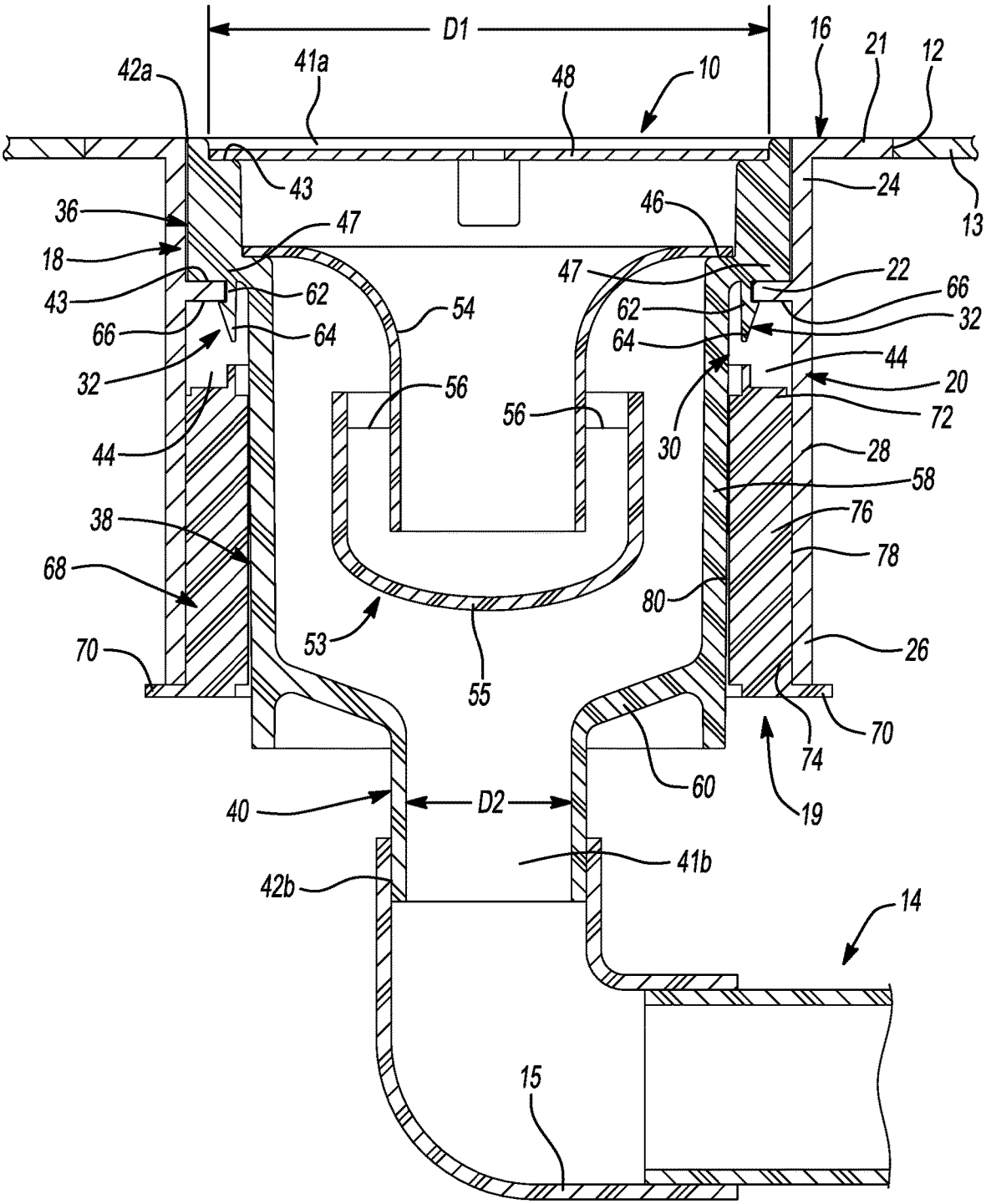
FIG. 3 is a cross-sectional view of the drain apparatus taken along line 3-3 of FIG. 2.
Figure 4:
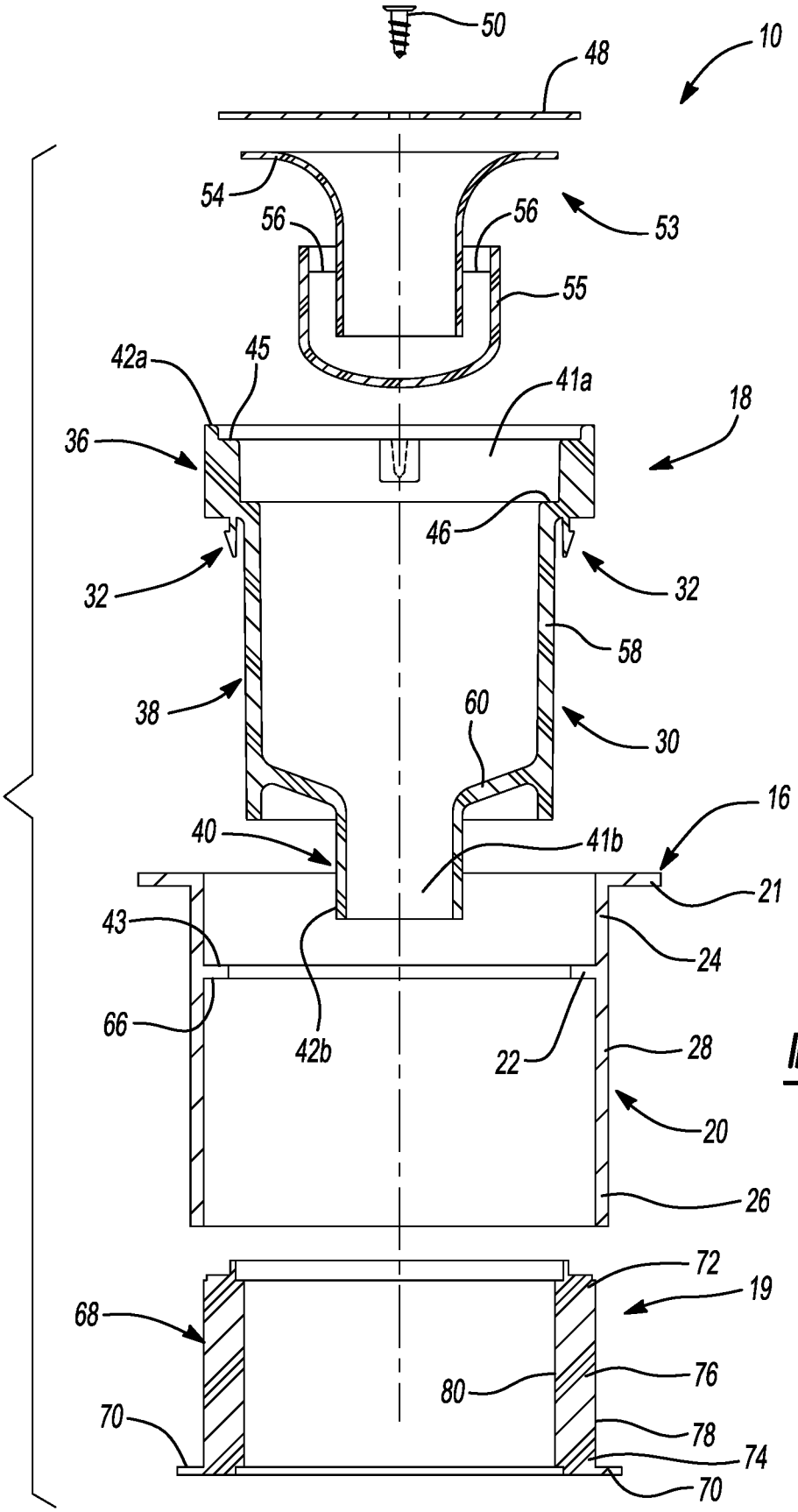
FIG. 4 is an exploded view of the drain apparatus.

The annular body 20 includes a top end 24, a bottom end 26 and a side wall 28 extending from the top end 24 to the bottom end 26. The flange 21 extends radially outwardly from the top end 24 of the body 20 and is configured to lie flush with the floor 13 (FIG. 3). The ledge 22 extends radially inwardly from the side wall 28 of the body 20 opposite the flange 21.

The drain pot 18 is annular-shaped and made of a polymeric material (e.g., cPVC). The drain pot 18 is configured to be removably installed within the body 20 of the adapter 16 such that fluids and debris on the floor 13 may drain therefrom and into the drain system 14 attached to the drain pot 18 (via the fitting 15). The drain pot 18 includes a body 30 and a plurality of flexible catches 32.

The body 30 is annular-shaped and includes a top portion or shoulder 36, an intermediate portion 38 and a bottom portion or spigot 40. The body 30 also includes an inlet 41*a* and an outlet 41*b* at opposing ends 42*a*, 42*b* thereof that are in fluid communication with each other. The inlet 41*a* is disposed at the top portion 36 and the outlet 41*b* is disposed at the bottom portion 40. The inlet 41*a* has a diameter D1 that is wider than a diameter D2 of the outlet 41*b*.

The top portion 36 has a thickness that is greater than the thickness of the intermediate portion 38 and the bottom portion 40. The top portion 36 extends radially outwardly from the intermediate portion 38 and is seated on a top side 43 of the ledge 22 of the deck adapter 16 when the drain pot 18 is installed within the body 20 of the adapter 16. In this way, a gap or space 44 (FIG. 3) is formed between the intermediate portion 38 of the body 30 of the drain pot 18 and the side wall 28 of the body 20 of the adapter 16. The top portion 36 includes a first ledge 45 and a second ledge 46. The first ledge 45 projects inwardly and is disposed at or near an end of the top portion 36 (i.e., the end of the top portion 36 is the end 42*a* of the body 30). The second ledge 46 also projects inwardly further than the first ledge 45 and is disposed at or near another end 47 of the top portion 36.

Figure 5:
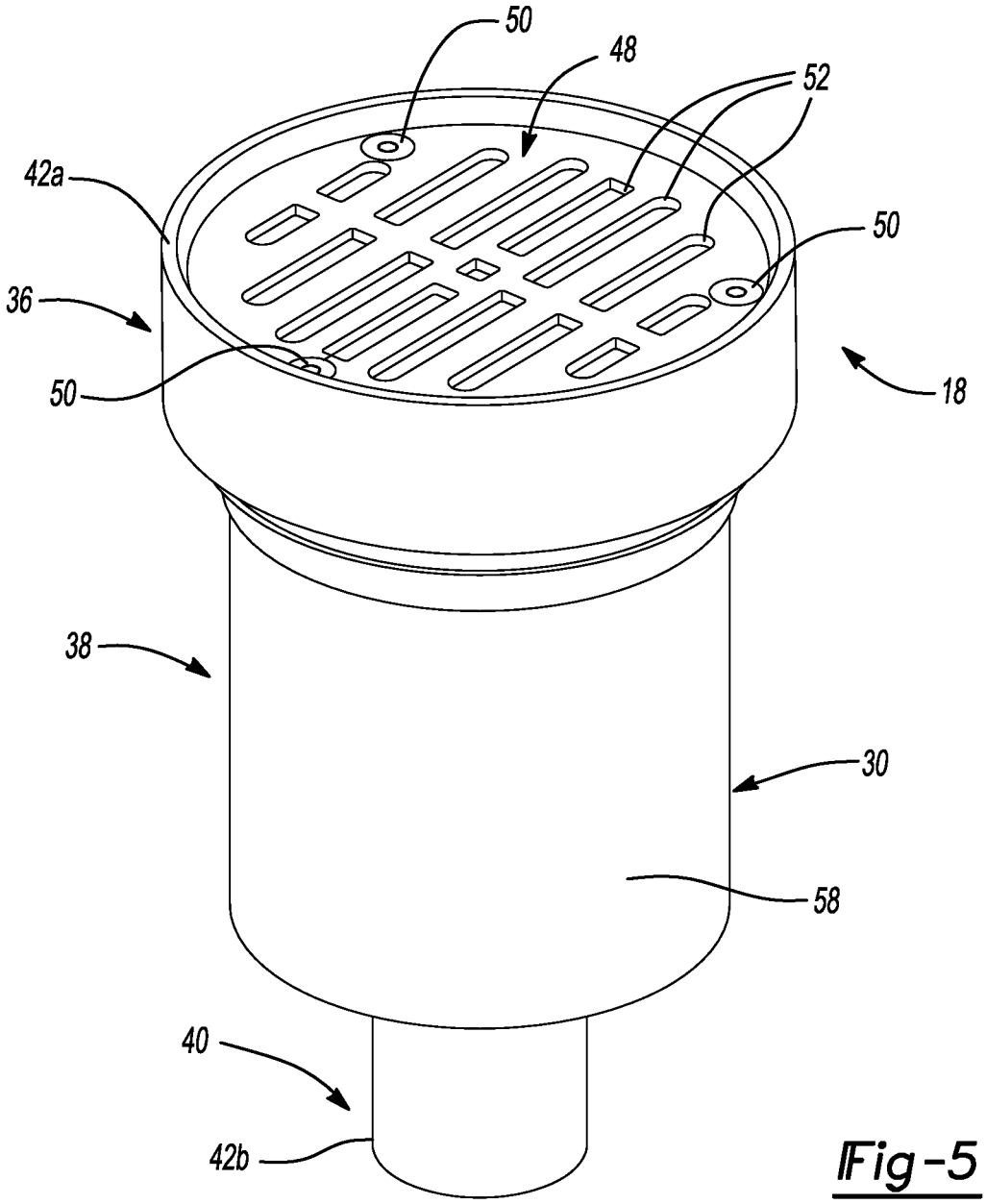
FIG. 5 is a perspective view of a drain pot of the drain apparatus.

A circular-shaped drain cover plate 48 is disposed on the first ledge 45 such that it is positioned just below the end of the top portion 36 (FIGS. 3 and 5; a gap exists between the end of the top portion 36 and the drain plate 48). The drain cover plate 48 may be made of a metal or polymeric material. The drain cover plate 48 is securely attached to the top portion 36 (via fasteners 50) and includes a plurality of slots 52 that are formed therein such that debris is separated from the fluid prior to the fluid passing through the drain plate 48.

In some configurations, the drain apparatus 10 may include a strainer assembly 53 having a funnel 54, a bowl 55 and a plurality of ribs 56. The funnel 54 is disposed on the second ledge 46 and has an opening 57 extending therethrough such that the fluid flowing through the drain pot 18 flows into the bowl 55. In this way, the bowl 55 is filled up with the fluid as the fluid flows through the drain pot 18, thereby preventing air from escaping from the drain system 14 up through the inlet 41*a* of the drain pot 18. The plurality of ribs 56 attach the funnel 54 to the bowl 55. It should be understood that other accessories may be disposed on the second ledge 46 instead of the strainer assembly 53. For example, in some configurations, a perforated plate (not shown) may be disposed on the second ledge 46, thereby further separating debris from the fluid draining from the floor 13. Openings (not shown) formed in the perforated plate (not shown) may be narrower than the slots 52 formed in the drain plate 48 such that smaller debris that flows through the drain plate 48 may be separated from the fluid prior to the fluid flowing through the perforated plate.

The intermediate portion 38 includes a side wall 58 and a sloped wall 60. The side wall 58 extends downwardly from the another end 47 of the top portion 36. The sloped wall 60 extends downwardly at angle from or near an end of the side wall 58 so as to direct fluid flowing through the drain pot 18 to the drain system 14 attached thereto (via the fitting 15). The bottom portion 40 extends downwardly from an end of the sloped wall 60 and is disposed within the fitting 15 (e.g., a 90 degree elbow fitting). The bottom portion 40 is securely attached the fitting 15 using solvent cementing, fusion techniques (e.g., thermofusion), or mechanical connections, for example.

The plurality of flexible catches 32 extend downwardly from the another end 47 of the top portion 36 and are disposed around the top portion 36 of the body 30. Each flexible catch 32 includes a first member 62 and a second member 64. The first member 62 extends in an axial direction from the another end 47 of the top portion 36. The second member 64 projects radially outwardly from an end of the first member 62. When the drain pot 18 is fully inserted into the opening 12 in the floor 13, the plurality of flexible catches 32 snap into engagement with the ledge 22 of the adapter 16 such that the drain pot 18 is locked into place (i.e., the second member 64 contacts a bottom side 66 of the ledge 22 to prevent the drain pot 18 from being removed from the opening 12 in the floor 13).

The fire stop 19 is annular-shaped and made of intumescent material. The fire stop 19 is removably installed from below in the gap 44 formed between the intermediate portion 38 of the drain pot 18 and the side wall 28 of the adapter 16 such that the fire stop 19 expands inwardly in the event of a fire, thereby pinching the drain pot 18 shut and restricting the fire from traveling between levels of the marine vessel, for example, via the drain pot 18. The fire stop 19 includes an annular body 68 and a flange 70. The annular body 68 includes a top end 72, a bottom end 74 and a side wall 76 extending from the top end 72 to the bottom end 74. The top end 72 is adjacent to the plurality of flexible catches 32. An outer surface 78 of the side wall 76 contacts the side wall 28 of the adapter 16 and an inner surface 80 of the side wall 76 contacts the intermediate portion 38 of the drain pot 18. The flange 70 extends radially outwardly from the bottom end 74 of the body 68 and is configured to abut against the bottom end 26 of the adapter 16 when the fire stop 19 is fully installed in the gap 44.

With continued reference to FIGS. 1-5, installation and removal of the drain apparatus 10 within the opening 12 in the floor 13 will be described in detail. To install the drain apparatus 10 within the opening 12 in the floor 13, the adapter 16 is first disposed in the opening 12 in the floor 13 and is also fixedly attached to the floor 13 via welding, for example. The drain pot 18 is then installed within the body 20 of the adapter 16 such that the plurality of flexible catches 32 snap into engagement with the ledge 22 of the adapter 16. In this way, the drain pot 18 is locked into place (i.e., the second member 64 contacts the bottom side 66 of the ledge 22 to prevent the drain pot 18 from being removed from the opening 12 in the floor 13). The fire stop 19 is then installed from below in the gap 44 formed between the intermediate portion 38 of the drain pot 18 and the side wall 28 of the adapter 16 such that the fire stop 19 expands inwardly in the event of a fire, thereby pinching the drain pot 18 shut and restricting the fire from traveling between levels of the marine vessel, for example, via the drain pot 18. Lastly, the bottom portion 40 of the drain pot 18 is securely attached to the drain system 14 (via the fitting 15).

The drain pot 18 is removed from the opening 12 in the floor 13 by first disconnecting the fitting 15 attached to the bottom portion 40 of the drain pot 18. The fire stop 19 is then removed from the gap 44 formed between the intermediate portion 38 of the drain pot 18 and the side wall 28 of the adapter 16. The plurality of flexible catches 32 are then biased inwardly (or broken) such that the second member 64 of the flexible catches 32 do not contact the bottom side 66 of the ledge 22 of the adapter 16. In this way, the drain pot 18 is removed from the opening 12 in the floor 13 and a new drain pot may be installed therein.

The drain pot 18 of the present disclosure is not subject to corrosion due to use of polymeric material. The drain pot 18 of the present disclosure also features a convenient snap in place installation method, thereby avoiding the need to cut or weld the floor (i.e., the deck of the marine vessel) when replacing or changing out the drain pot 18.

Figure 6:
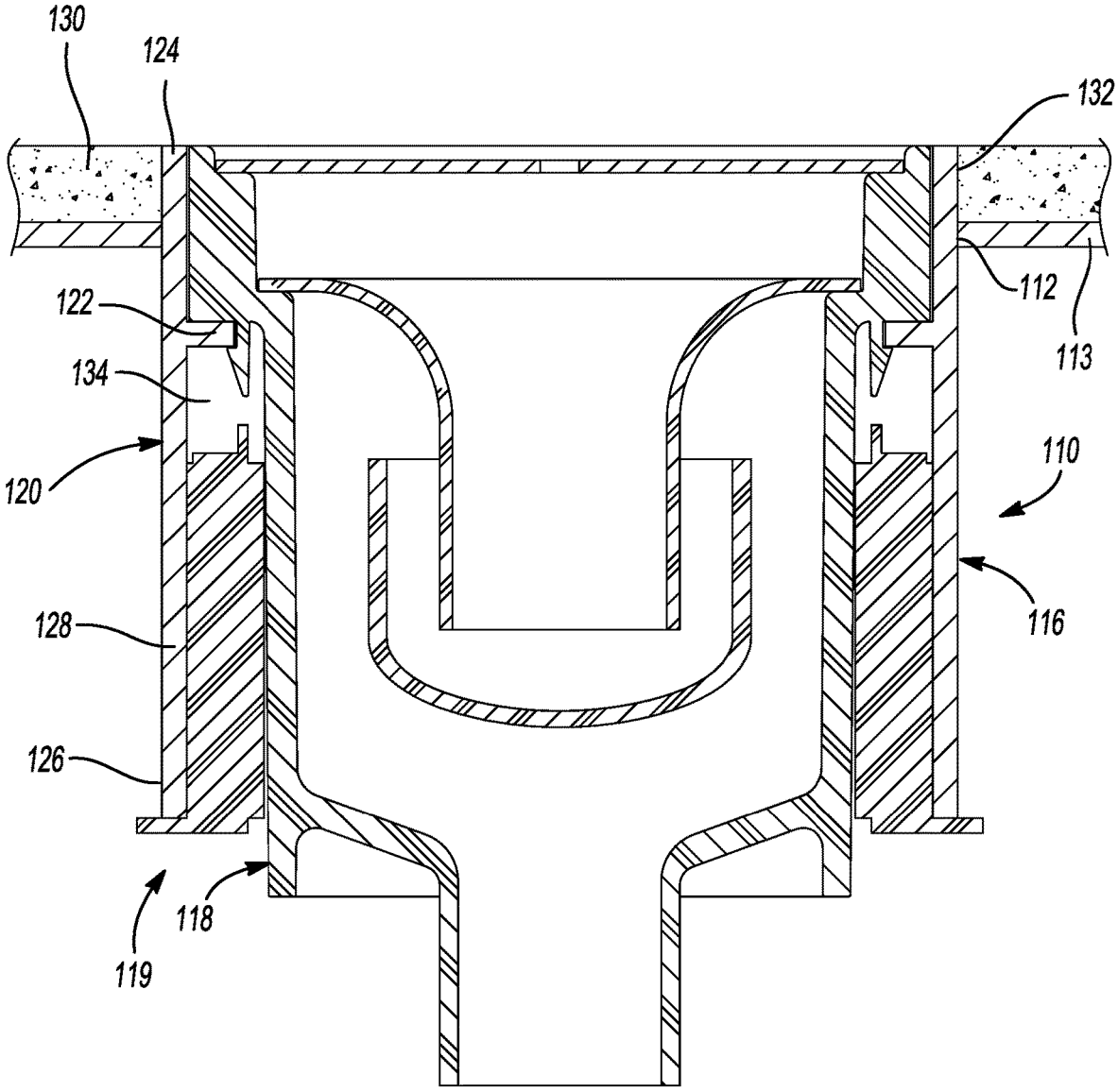
FIG. 6 is a cross-sectional view of another drain apparatus.

With reference to FIG. 6, another drain apparatus 110 is provided. The structure and function of the drain apparatus 110 may be similar or identical to the drain apparatus 10 described above, apart from any exception described above.

The drain apparatus 110 is disposed within an opening 112 in a first floor 113 (e.g., a deck in a marine vessel) and includes a deck adapter 116, a drain pot 118 and a fire stop 119. The deck adapter 116 is annular-shaped and made of a metallic material. The deck adapter 116 is disposed within the opening 112 in the first floor 113 and is fixedly attached to the first floor 113 using any suitable method of attachment (e.g., welding). The deck adapter 116 includes an annular body 120 and a ledge 122.

The annular body 120 includes a top end 124, a bottom end 126 and a side wall 128 extending from the top end 124 to the bottom end 126. The top end 124 protrudes upwardly from the floor 113 when the deck adapter 116 is fixedly attached to the first floor 113. In this way, a second floor 130 (e.g., a finished floor) having an opening 132 may be disposed on top of the first floor 113 such that the drain apparatus 110 is received in the opening 132 and the second floor 130 lies flushed with the top end 124 of the body 120. The ledge 122 extends radially inwardly from the side wall 128 of the body 120.

The drain apparatus 118 may be similar or identical to the drain pot 18 described above, and therefore, will not be described again in detail. The drain pot 118 is configured to be removably installed within the body 120 of the adapter 116 such that fluids and debris on the second floor 130 may drain therefrom and into the drain system (not shown) attached to the drain pot 118. The fire stop 119 may be similar or identical to the fire stop 19 described above, and therefore, will not be described again in detail. The fire stop 119 is removably installed from below in a gap 134 formed between the drain pot 118 and the side wall 128 of the adapter 116 such that the fire stop 119 expands inwardly in the event of a fire, thereby pinching the drain pot 118 shut and restricting the fire from traveling between levels of the marine vessel, for example, via the drain pot 118. The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A drain pot for a floor, the drain pot comprising:

a body having an inlet and an outlet, the inlet and the outlet at opposing ends of the body and in fluid communication with each other;

at least one flexible catch extending from and disposed around the body, wherein a portion of the body extends radially outwardly further than the flexible catch extends radially outwardly; and the portion of the body being configured to engage a member disposed beneath the floor.

2. The drain pot of claim 1, wherein the body is annular-shaped.

3. The drain pot of claim 2, wherein the body includes a top portion, an intermediate portion and a bottom portion.

4. The drain pot of claim 3, wherein the inlet is disposed at the top portion and the outlet is disposed at the bottom portion.

5. The drain pot of claim 4, wherein the inlet has a diameter that is wider than a diameter of the outlet.

6. The drain pot of claim 5, wherein the at least one flexible catch extends downwardly from the top portion of the body.

7. The drain pot of claim 6, wherein the top portion includes a first ledge and a second ledge.

8. The drain pot of claim 7, further comprising a drain plate that is disposed on the first ledge of the top portion.

9. The drain pot of claim 1, wherein the body and the at least one flexible catch is made of a polymeric material.

10. A drain apparatus for a deck in a marine vessel, the drain apparatus comprising:

an adapter disposed within an opening in the deck of the marine vessel and attached to the deck of the marine vessel; and a drain pot configured to be removably installed within the adapter and including a body and at least one flexible catch, the body having an inlet and an outlet at opposing ends thereof and in fluid communication with each other, the at least one flexible catch extending from and disposed around the body and engaging the adapter.

11. The drain apparatus of claim 10, further comprising a fire stop configured to be removably installed in a gap formed between the adapter and the body of the drain pot.

12. The drain apparatus of claim 11, wherein the drain pot is made of a polymeric material.

13. A drain apparatus for a deck in marine vessel, the drain apparatus comprising:

an annular deck adapter configured to fit within an opening in the deck of the marine vessel; the adapter including:

an annular body having a top end, a bottom end and a side wall extending from the top end to bottom end;

the body extending downwardly in an opening in the deck;

a ledge extending radially inwardly from the side wall of the body;

a polymeric drain pot configured to be removably installed within the body of the adapter.

14. The apparatus of claim 13, wherein the drain pot includes at least one flexible catch for engaging the ledge of the adapter.

15. The apparatus of claim 14, wherein the body includes a flange extending radially outwardly from the top end of the body such that the flange is flushed with the deck.

16. The apparatus of claim 14, wherein the top end of the body protrudes upwardly from the deck of the marine vessel and is flushed with a floor disposed on top of the deck.

17. The apparatus of claim 15, wherein the drain pot includes a body having a top portion, an intermediate portion and a bottom portion.

18. The apparatus of claim 17, wherein the top portion extends radially outwardly from the intermediate portion and is seated on a top side of the ledge of the adapter, leaving a space between the body of the adapter and the intermediate portion of the drain pot.

19. The apparatus of claim 18, further comprising a fire stop configured to be removably installed in the space between the body of the deck adapter and the intermediate portion of the drain pot.

20. The apparatus of claim 19, further comprising a drain plate disposed on an inwardly projecting ledge formed in the top portion of the drain pot, above the ledge of the adapter and adjacent an end of the body of the drain pot.

21. The apparatus of claim 13, wherein the drain pot has a catch that cooperates with the ledge to hold the drain pot within the body of the adapter.

22. The apparatus of claim 21, wherein at least a portion of the catch is positioned below the ledge of the adapter.

23. The apparatus of claim 21, wherein drain pot includes a plurality of catches.

24. The apparatus of claim 21, wherein the drain pot includes a body seated on the ledge of the adapter, and wherein the ledge is positioned between the catch and a top portion of the body.

25. The apparatus of claim 21, wherein the annular deck adapter is made of a metallic material.

* * * * *